US006834583B1

(12) United States Patent
Miller et al.

(10) Patent No.: US 6,834,583 B1
(45) Date of Patent: Dec. 28, 2004

(54) SILK SCREEN ASSEMBLY

(75) Inventors: Michael J. Miller, Evans City, PA (US); Larry J. Miller, Harmony, PA (US)

(73) Assignee: Miller Screen & Design, Inc., Mars, PA (US)

( * ) Notice: Subject to any disclaimer, the term of this patent is extended or adjusted under 35 U.S.C. 154(b) by 0 days.

(21) Appl. No.: 10/658,573

(22) Filed: Sep. 9, 2003

(51) Int. Cl.[7] ..... B05C 17/06; B05C 17/08; B41L 13/00

(52) U.S. Cl. ..... 101/127; 101/127.1; 101/112; 101/114; 101/126; 101/128.4

(58) Field of Search ..... 101/127, 127.1, 101/128.1–128.4, 112–114, 125, 128; 209/403

(56) References Cited

U.S. PATENT DOCUMENTS 3,167,004 A * 1/1965 Miller et al. ..... 101/127.1
3,894,487 A * 7/1975 Miller ..... 101/129
4,137,842 A * 2/1979 Miller ..... 101/128.21
4,373,441 A * 2/1983 Messerschmitt ..... 101/127.1
4,520,727 A * 6/1985 Miller ..... 101/127
5,097,761 A * 3/1992 Hamu ..... 101/127.1
5,802,971 A * 9/1998 Hamu et al. ..... 101/127.1
5,979,312 A * 11/1999 Williams ..... 101/127

* cited by examiner

*Primary Examiner*—Andrew H. Hirshfeld
*Assistant Examiner*—Marissa Ferguson
(74) *Attorney, Agent, or Firm*—Clifford A. Poff

(57) ABSTRACT

A stencil screen with a desired pattern to be imprinted is supported on a stencil screen frame. The frame has upstanding elongated sidewalls joined by spaced apart end walls to circumscribe a screen window opening. The stencil screen has sufficient strength transversely to plane of the screen to allow deflection from the plane of the screen without elastic deformation. The stresses produced by the deflection of the screen produce repeated flexing of fatigue resistant and resilient screen frame sidewalls and screen support arms at opposite end of these side walls by the provision of sufficient resiliency to restore the stencil screen to a stencil screen support plane.

19 Claims, 5 Drawing Sheets

SILK SCREEN ASSEMBLY

CROSS-REFERENCE TO RELATED APPLICATIONS

Not applicable

BACKGROUND OF THE INVENTION

1. Field of the Invention

The present invention relates to a screen assembly for applying decorative imprints to articles, and more particularly, the present invention relates to the construction of carrier for a silk screen including at least one but preferably both of upstanding elongated sidewalls and screen frame support arms each having sufficient resiliency to restore the screen to a screen support plane after a squeegee displaced the screen when forcing a printing medium through a desired pattern in the screen.

2. Description of the Prior Art

Silk screen printing is well known in the art and takes it name from the original use of a screen made of woven silk thread. More recently, the silk screen printing process uses a screen made from thread-like filaments comprised of materials such as plastics e.g., rayon, when printing with solvent based paint and metal e.g. stainless steel to allow electrically resistive heating of the screen when printing with thermo plastic paint. Silk screen printing is extensively employed to apply decoration to surfaces of mass-produced articles of manufacture. The decoration may be applied to produce simple schemes or patterns or they may be applied in more elaborate decorative designs including manufacturer's names, product names, logos, and similar types of information. During printing, the paint medium such as ink is forced by a squeegee through exposed areas of the screen, which delineate the intended design to be applied to the surface of the article. Examples of prior art silk screen printing apparatus using thermo plastic paint are disclosed in U.S. Pat. Nos. 3,894,487; 4,137,842; and 4,520,727. Thermo plastic paint is maintained in a fluid state by electric resistive heating of a metallic wire mesh screen secured to but electrically insulated from a metal support frame. The wire mesh screen is stretched between edges of the frame so that end portions of the wire mesh can be wrapped to extend along the sides of the frame and secured thereto. The screen is usually stretched to maintain sufficient tension to eliminate wrinkles in the screen and prevent distortions of the desired pattern usually located in a central area of the screen surrounded by the sides of the frame. The screen is stretched by the squeegee to a small extent each time the printing medium is forced through the paint-pervious openings by the squeegee. Sometimes the frame is moved along a path of travel relative to a stationary squeegee to force ink through the paint-pervious openings in the screen; however, other drive systems for the printing process provide that the squeegee move along a path of travel relative to a stationary screen.

After prolonged use of the screen, the metal or other material used to form the screen fatigues producing distortion to the intended design and leading to the screen failure usually appearing as a tear in the screen. When this occurs, the screen must be replaced and usually the entire screen assembly is removed from the decorating machine and a replacement screen installed on the machine. The rigorous use of the screen assembly particularly in a high through put volume decorating machine required a robust frame construction to withstand the repetitive flexing of the screen by the squeegee. The use of a heavy iron casting with thick wall construction is typical. The cost of the cast iron frame adds to the printing costs in terms of the initial investment and maintenance needed to clean encrusted printing medium from the frame before each periodic replacement of the silk screen. The foregoing patents addressed extending the fatigue life of the screen material by attaching a resilient gasket to the lower edge surface of the frame to avoid stretching of the screen across the sharp edges of the cast iron frame. However, fatiguing of the screen material still occurs because the screen must be pressed into contact with the workpiece by movement of the squeegee during movement relative to the screen. The screen is normally positioned a short distance from the surface of the workpiece so that an air gap exists between the screen and the workpiece. The squeegee is moved to displace the screen by the distance of the air gap into contact with the workpiece.

In the printing operation, the silk screen is pushed slightly outwardly in a downward direction from the frame and drawn taut by the squeegee during each design transfer. Upon completion of the transfer of the design, the squeegee is retracted and the screen is permitted to relax to its original condition. The screen is adaptable to printing on a wide variety of surfaces and/or articles of manufacture, but unfortunately, particularly when printing on a flat substrate, the continuous tensioning and relaxing of the wire mesh material of the screen soon causes unavoidable and harmful fatigue of the material, particularly where the material is in contact with the lower edges of the metallic frame, hence leading to failure of the screen. A further disadvantage of silk screen apparatus of this type is that the wire mesh screen cannot always be tensioned uniformly over the entire area encircled by the screen support frame. For example, the screen is usually tensioned and adhered by cement along substantial portions of the frame beyond the rubber boot which surrounds the bottom edge of frame while the remaining portions of the screen are held in metal compression clamps, which act as electrical bus bars at times when the screen is electrically heated. The compression clamps are usually adjustable by screw fasteners to opposite ends of the screen support frame.

Due to its inherent lack of elasticity, a metallic wire mesh screen is difficult to stretch across the rubber boot under sufficient tension to cause the screen to tightly conform to the shape of the frame. Consequently, the wire mesh screen can only be effectively tensioned along its length dimension where its clamped ends are adjustably connected to the frame by the aforementioned screw fasteners. Such non-uniform tensioning of the screen has been known to produce wrinkles and/or other variably tensioned areas in the screen which deleteriously affect the quality of the image which is transferred by the screen to the article. Such screens further have relatively limited inherent resiliency. This generally does not create a problem during many printing operations since the resiliency of the screen was used to accommodate the tensioning and relaxing by the squeegee. However, at times when thermally responsive printing medium is applied by the screen printing apparatus, i.e., at times when the screen and printing medium are heated, the thermally responsive printing medium, if applied to a substantially cooler surface such as glass, for example, quickly sets upon contact therewith. In such thermally dependent printing operations, it would be most advantageous if the screen structure could be provided with greater inherent resiliency whereby it would positively and reliably return to its initial position upon passage of the squeegee to thereby prevent sticking or blocking of the screen to the cooler article surface. U.S. Pat. No. 4,373,441 and German Offenlegungsschrift No. 29 16 391 disclose composite silk screen apparatus which require elaborate constructions involving electroplating opposite end portions of a metallic silk screen that are thermo plastically secured to a thermoplastic synthetic resin material such that the thermoplastic securement between the wire silk screen and the resin material is not damaged during electrical resistance heating of the silk screen.

An advantage exists, therefore, for a silk screen assembly where a metal frame to support the silk screen is constructed with sufficient resiliency to impart a resistance to metal fatigue of the silk screen and maintain a uniform resiliency across the screen during a printing operation.

It is accordingly an object of the present invention to provide a frame assembly for supporting a silk screen to resist metal fatigue and allow flexing of the frame assembly when the silk screen is displaced by a squeegee to force printing medium through the openings in the silk screen.

It is a further object of the present invention to provide a silk screen printing apparatus having screen frame assembly to tension a printing screen in all directions within the plane of the silk screen to thereby provide a high-quality image transfer surface.

It is a further object of the present invention to provide a silk screen printing assembly having a screen frame construction designed to exhibit a useful highly resilient property and, therefore, especially useful in thermally dependent printing applications wherein a substantial temperature differential exists between the silk screen and the article surface being coated such a highly resilient printing screen frame construction thereby preventing adhering of the screen to the article surface which is caused by the rapid cooling and setting of the thermally responsive printing medium upon contract with the cooler article surface.

It is another object of the present invention to provide a silk screen printing apparatus having a screen frame construction, which permits accurately controllable and essentially uniform electrical resistance heating of the screen in the instances where the printing medium is thermally responsive.

It is an another object of the present invention to provide a screen frame construction having resilient longitudinal side walls and resilient screen support arms for attaching a frame for support so that the resiliency of the side walls and/or support arms can withstand repeated flexing movement of the middle portion of the screen toward and away from the workpiece as a printing medium is forced through a desired pattern in the screen.

SUMMARY OF THE INVENTION

Thus, in accordance with the present invention the foregoing problem of fatiguing of the screen material is reduced by providing a stencil screen assembly including the combination of a stencil screen having a desired pattern to be imprinted defined by an adhered paint-impervious layer, the stencil screen having sufficient strength transversely to plane of the screen to allow deflection from the plane of the screen without elastic deformation, a rectangular stencil screen frame including upstanding elongated sidewalls joined by spaced apart upstanding end walls to circumscribe a screen window opening establishing a stencil screen support plane, and screen support arms secured to the rectangular stencil screen frame to extend outwardly from the end walls, at least one of the upstanding elongated sidewalls and the screen support arms having sufficient resiliency to allow displacement and restoration of the stencil screen to the stencil screen support plane when displaced there from by a squeegee while traversing the desired pattern to be imprinted.

Preferably, the upstanding elongated sidewalls having sufficient resiliency to restore the stencil screen to the stencil screen support plane when displaced there from by the squeegee. The upstanding elongated sidewalls and upstanding end walls are defined by L shaped cross sectional configurations having upstanding heights defining an ink reservoir volume above an internally projecting foot mitered at juncture sites between each of the side walls and the end walls, the projecting foot of each of the upstanding elongated sidewalls defining a screen mounting shelf. An electrically insulating coating on the upstanding elongated sidewalls and the upstanding end walls electrically isolates the stencil screen frame from the stencil screen and an electrically insulating layer of adhesive bounds an outer marginal edge portion of the stencil screen to the mounting shelf of the sidewalls. The stencil screen includes electrically conductive terminal end portions extending from the upstanding elongated sidewalls along the screen support arms and pressed into electrically conductive contact with underlying bus bars substantially corresponding to the width of the stencil screen.

BRIEF DESCRIPTION OF THE SEVERAL VIEWS OF THE DRAWINGS

The present invention will be more fully understood when the following description is read in light of the accompanying drawings in which.

DETAILED DESCRIPTION OF THE INVENTION

Figure 1:
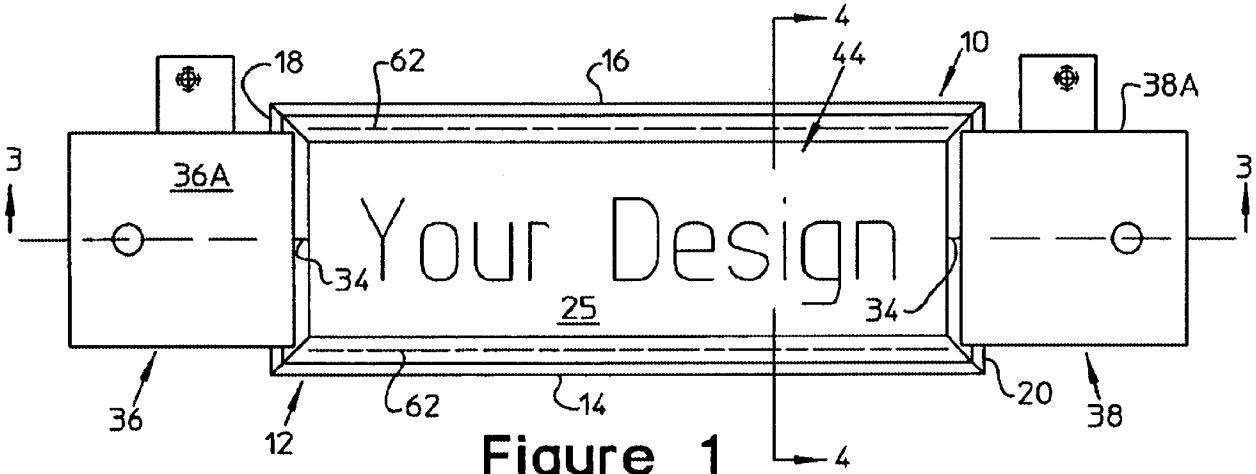
FIG. 1 is a plane view of a silkscreen assembly embodying the features of the present invention.
Figure 2:
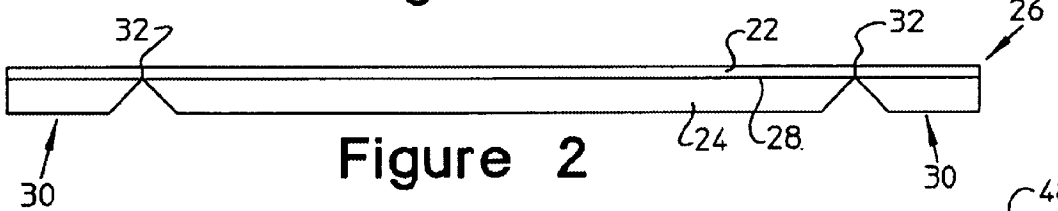
FIG. 2 is a plane view illustration of one half of a rectangular frame part used in the silkscreen assembly of FIG. 1.
Figure 3:
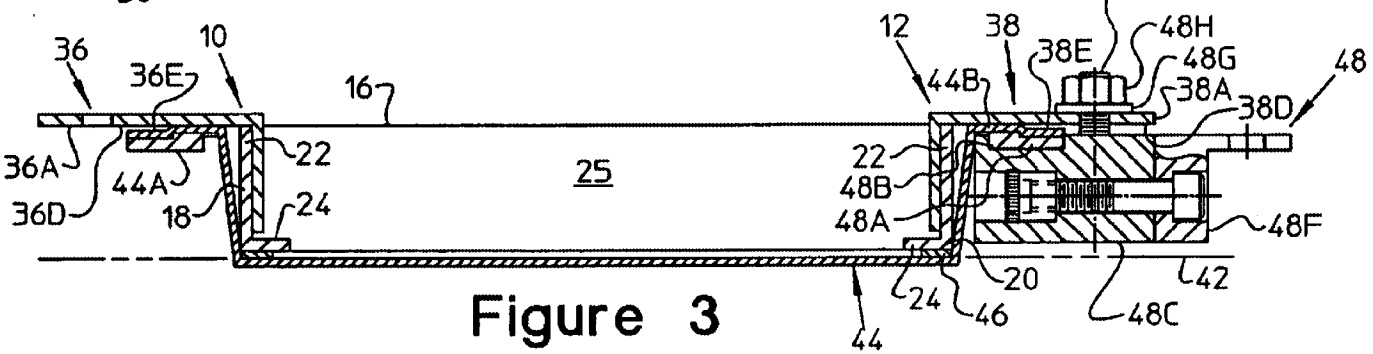
FIG. 3 is a sectional view taken along lines 3—3 of FIG. 1.
Figure 4:
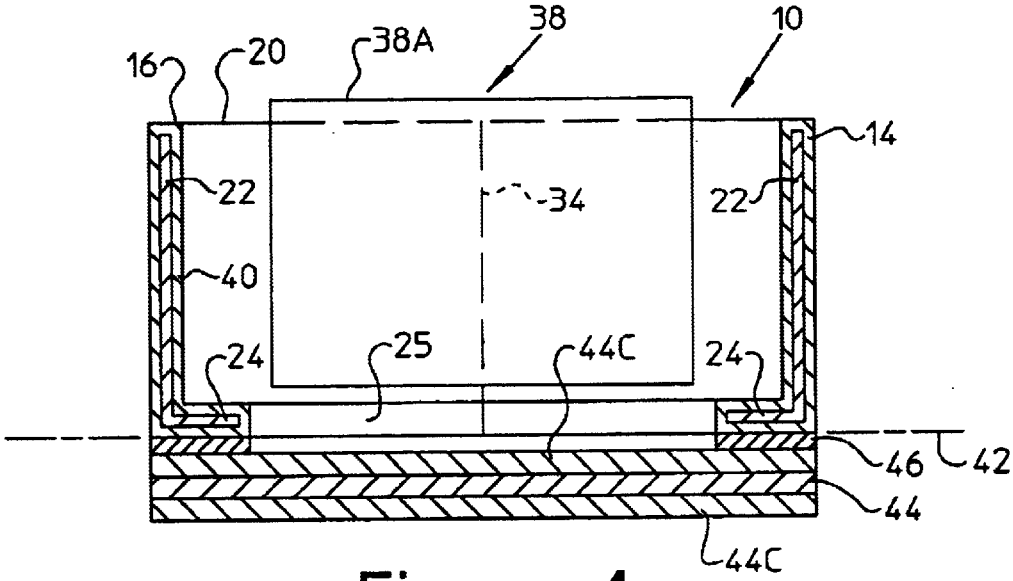
FIG. 4 is a sectional view taken along lines 4—4 of FIG. 1.

With reference to FIGS. 1–4, there is illustrated a stencil screen assembly 10 to apply decorative imprints to a substrate. The substrate may comprise a glass beverage container. The assembly 10 includes a stencil screen frame 12 with upstanding elongated sidewalls 14 and 16 that are spaced apart by end walls 18 and 20. The frame can be rectangularly, square, or circular shaped and dimensioned, as necessary, to suit the requirements for the intended screening operation. The sidewalls 14 and 16 and end walls 18 and 20 as shown in FIGS. 3 and 4 each embody a L-shaped cross sectional configuration formed by a side plate section 22 upstanding from an integral lateral extending foot section 24. The area bounded by the sidewalls 14 and 16 and end walls 18 and 20 forms an ink reservoir 25 to maintain a supply of thermo plastic ink, the printing medium, for the applying the decorative imprints to an article. As shown in FIG. 2, the stencil screen frame 12 is fabricated preferably from two equal lengths of a thin steel sheet 26 and each sheet is deformed into a right angle, L shaped cross sectional configuration by bending the sheet along a crease line 28, resulting in the formation of the plate section 22 and the foot section 24. Two end half-lengths 30 are established by miter cuts in the foot sections at two sites, which are used to establish two sites for right angle bends 32 in the side plate section 22. The miter cuts may comprise angular cuts at 45° to the elongated length of the sheet 26 or, if desired, rectangular notches can be cut from one of adjoining ones of the foot sections to provide clearances for receiving the correspondingly shaped section of the displaced adjacent foot section. The resulting steel sheet fabrication is a half-divided part of the screen frame 12. Two of these steel sheet fabrications are welded together along seam lines 34 located in end walls 18 and 20. Thereafter, screen support arms 36 and 38 are arranged with a plate section 36A and 38A, respectively, extending from opposite ends of the screen frame and secured by welding a right angled, mounting leg extension to an inside wall face of the respective end walls 18 and 20. These right-angled mounting leg extensions structurally reinforce the end walls 18 and 20 of the screen frame.

A feature of the present invention resides in a long continued useful life of the stencil screen 10 by design to function with an elastically flexible response to traversing by a squeegee while the desired pattern is printed. The screen support arms 36 and 38 are each resilient and take the form of elongated plate section having a relative thin thickness e.g. within the range of 18 to 22 gage, and a sufficiently fatigue resistant to with stand repeated flexing. As shown in FIG. 4, after completion of the welding operations needed to form the screen frame, the weldment then receives a coating 40 comprised of a high density powdered paint that essentially includes particles of pigment and high density electrical insulation material. The coating 40 is fused to the steel of the weldment by heating to form a tightly adhered layer in a manner per se well known in the art. The coating on the upstanding elongated sidewalls and the upstanding end walls electrically insulate the rectangular stencil screen frame 12 from a stencil screen.

The lateral extending foot sections 24 of screen frame 12 circumscribe a screen window opening and lie in a support plane 42 for a stencil screen 44. The screen is externally tensioned to establish a predetermined preloading in the longitudinal and transverse directions within the plane of the screen. While the screen is tensioned, the foot sections 24 are used to form a screen mounting face surface receptive to a layer of adhesive 46 for adhering peripheral margin of a stencil screen 44 to the screen frame. Thereafter, any excess screen extending outwardly of only the sidewalls 14 and 16 is removed. When the screen 44 is used to heat thermo plastic paint according to the preferred embodiment, the screen is made of fine wire mesh of stainless steel that is suitable for heating by passage of an electrical current. Buss bars leads 44A and 44B are formed by residual lengths of screen extending externally of the frame outwardly from opposite directions from the end walls 18 and 20. The buss bars leads 44A and 44B are resiliently bent to extending perpendicularly from the support plane 42 along the outer surface of the end walls 18 and 20 and thence laterally along the overlying face surface of the screen support arms 36 and 38, respectively. The predetermined preloading of the screen 44 in the longitudinal and transverse directions within the plane 42 is at least substantially maintained after solidification of the layer of adhesive 46. The layer of adhesive is chosen from well known adhesive materials with the property of electrically insulating on the foot sections 24 of the stencil screen frame from the stencil screen.

A paint-impervious layer 44C is adhered to the outer periphery of the stencil screen 44 and in inward areas to define a desired pattern to be imprinted by paint forced through remaining paint pervious areas in the screen. The paint-impervious layer 44C is established before the screen is secured to the screen frame by impregnating the screen with an emulsion or other non-porous substance to leave a residual film using suitable well-known techniques for defining the design of an image to be printed. In FIG. 1, for the purpose of illustration only, there are exposed areas of the screen forming the words "YOUR DESIGN" within an area of the screen. The stencil screen is electrically insulated from the metal of the screen frame by the coating 40 on the frame, the layer of adhesive 46 and the paint impervious layer 44C that extends about the outer peripheral margin of the screen.

FIGS. 3, 5, 6 and 7 illustrate the details of the construction of a preferred embodiment of a screen holder assembly 48 provided at each end of the screen frame for mounting the screen frame assembly 12 to control arms of a decorating machine and, when needed, establishing electrical contact with the stencil screen for electrical resistive heating of the screen and thermo plastic ink. Each screen holder assembly 48 includes an elongated buss bar 48A formed with a raised electrical contact rib 48B transversely arranged above a planer face surface of an electrical insulator block 48C. A fastener attaches an electrical lead wire, not shown, to a bar extension 48D protruding from a lateral side of the buss bar 48A. A fastener bolt 48E is retained on the mounting block 48C for attaching the holder assembly 48 to the screen frame. An L-shaped bracket 48F is secured to an end face of the electrical insulator block 48C and used to receive a threaded fastener for securing the screen holder assembly to a control arm of the decorating machine.

Openings in the protruding outer margins of the plate sections 36A and 38A receive fastener bolts 48E of the two screen holder assemblies 48 and after application of a washer 48G and nut member 48H, torque is applied to the nut members 48I to press the raised electrical contact ribs 48B of the associated buss bars 48A into contact and under a clamping force against the buss bars leads 44A and 44B. The screen support arms 36 and 38 defines frame support areas 36D and 38D each containing an aperture for receiving a threaded fastener for securing the screen to a printing machine. The frame support areas 36D and 38D are spaced outwardly from elongated bus bar compression sites 36E and 38E used for establishing electrical conductivity with electrical bus bars. The widths of the plate sections 36A and 38A substantially correspond to the width of the stencil screen traversing the spaced apart end walls. An important feature of the present invention resides in the unimpeded access to the buss bar leads and the maintained width of the buss bars distributing the current density across the full width of the screen substantially corresponding to the width of the end walls 18 and 20. A substantial advantage is realized by this relationship, which avoids the formation of localized hot spots due to non uniform electrically resistive loading. The present invention eases the procedure for establishing electrical conductivity between the buss bar leads 44A and 44B and the elongated buss bars 48A by the environment providing electrical isolation of the from the steel sheet fabrication forming the screen frame. This electrical isolation has the advantage to an operator of allowing the establishment of an electrical buss bar contact by only the clamping pressure needed to press the buss bar leads 44A and 44B into electrical contact with the buss bars 48A.

Figure 8:
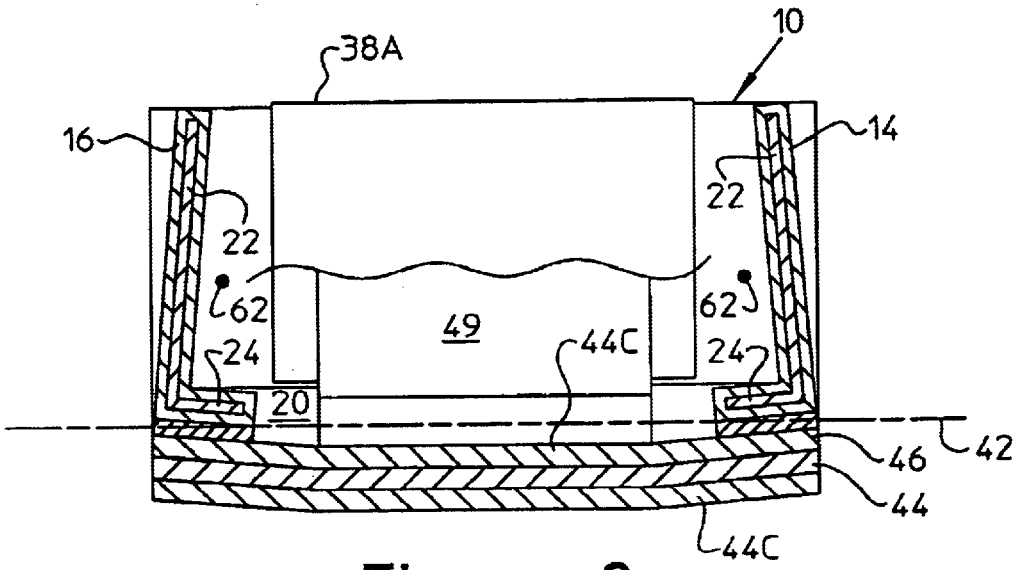
FIG. 8 is a sectional view similar to FIG. 4 and illustrating deflection of a screen frame via the silk screen by a squeegee according to the present invention.
Figure 5:
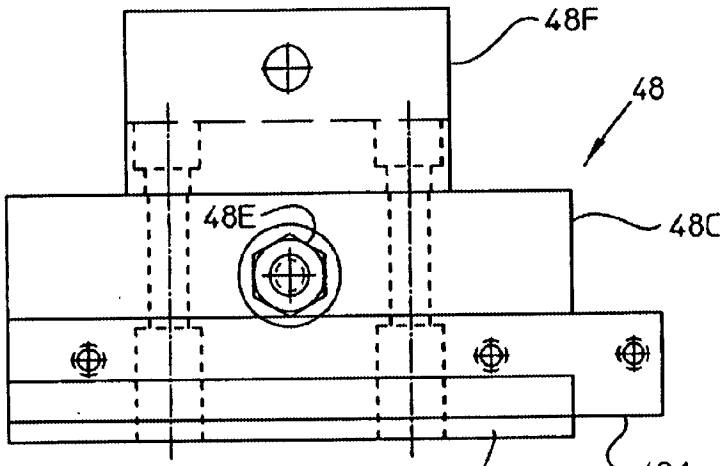
FIG. 5 is an enlarged plan view of a screen holder assembly forming part of the silk screen assembly of the present invention.
Figure 6:
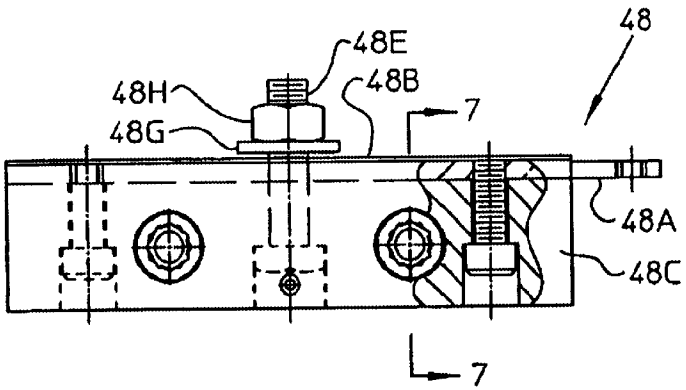
FIG. 6 is a front elevational view of the screen holder assembly as shown in FIG. 5.
Figure 7:
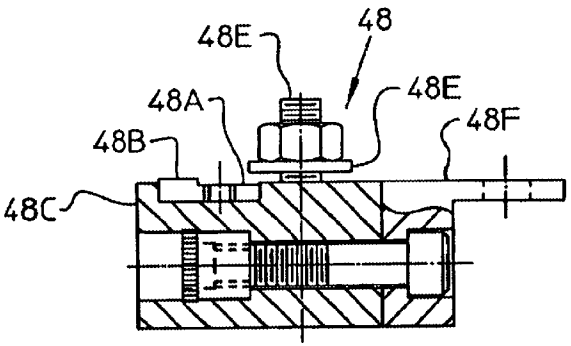
FIG. 7 is a section view taken along lines 7—7 of FIG. 6.
Figure 9:
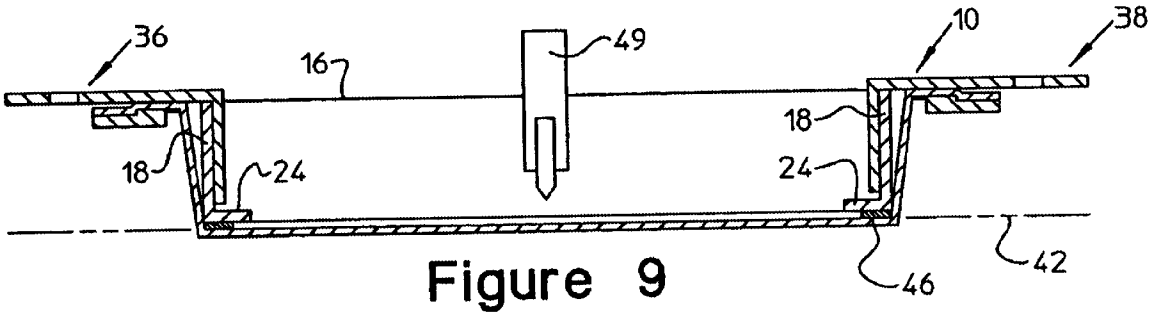
FIG. 9 is a view similar to FIG. 3 illustrating the inoperative position of a squeegee and an ink reservoir of the silk screen assembly of the present invention.
Figure 10:
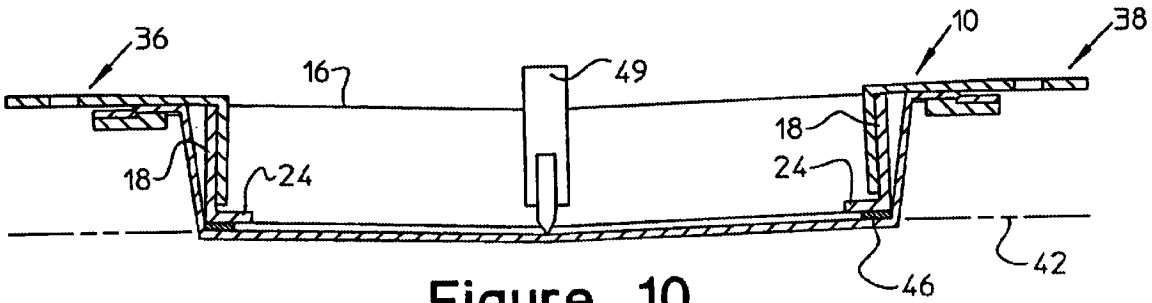
FIG. 10 is a view similar to FIG. 9 showing deflection of the screen support arms and silk screen in the operative position of a squeegee during displacement along a screen assembly of the present invention.
Figure 11:
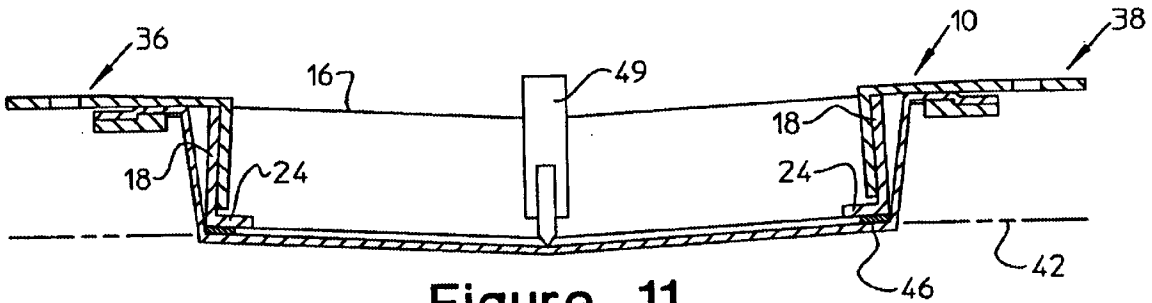
FIG. 11 is a view similar to FIG. 9 showing deflection of the screen frame, screen support arms and silk screen in the operative position of a squeegee during displacement along a screen assembly of the present invention.

The plate sections 22 of the upstanding elongated sidewalls 18 and 20 are thin walled in relation to the length and height of the L-shaped cross sectional configuration and used to provide sufficient resiliency to restore the stencil screen to the stencil screen support plane 42 when displaced by a squeegee 49 while traversing the desired pattern to be imprinted. As best shown by comparing FIGS. 4 and 8, the displacement of the screen, exaggerated for illustrative purposes only, by the vertical movement of the squeeze is sufficient to displace the screen into contact with the surface of an underlying workpiece and concurrently produce an elastic displacement of the plate section 22 forming the elongated sidewalls 18 and 20 toward each other. This inward elastic bending of the side walls relieves the stencil screen of a significant part of the stress usually isolated prior art forms of screen frames made of cast iron or cast aluminum. The width of foot sections 24 of the screen frame can be reduced by, for example, 10% or more to enhance to elastic properties structural shape of the screen frame. Thus, according to the present invention the sidewalls take on the function of storing energy for the subsequent function of applying a restoring force to return the screen to the stencil screen support plane 42. FIGS. 9, 10 and further illustrate the displacement of the screen, exaggerated for illustrative purposes only, by the vertical movement of the squeeze 49. The present invention also provides that the screen support arms 36 and 38 are also elastic flexed in a similar manner as the elastic flexing of the plate section 22 as the screen is displaced into contact with the surface of an underlying workpiece. The elastic flexing of the screen support arms 36 and 38 produces downward elastic bending of these arms as illustrated in exaggerated form in FIGS. 10 and 11 which also serves to relieve the stencil screen of a significant part of the stresses occurring during the decorating of a workpiece. Furthermore, the screen frame functions to absorb mechanical shock due to resilient nature of the screen frame design, particularly in the unlikely event when a workpiece breaks loose from the drive and support structure of the decorating machine.

Figure 12:
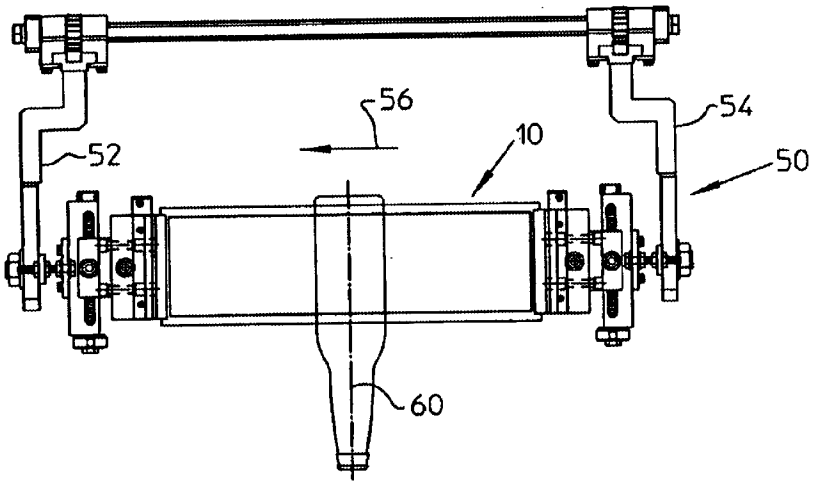
FIG. 12 is a partial plan view of a decorator machine incorporating a screen assembly embodying the features of the present invention.
Figure 13:
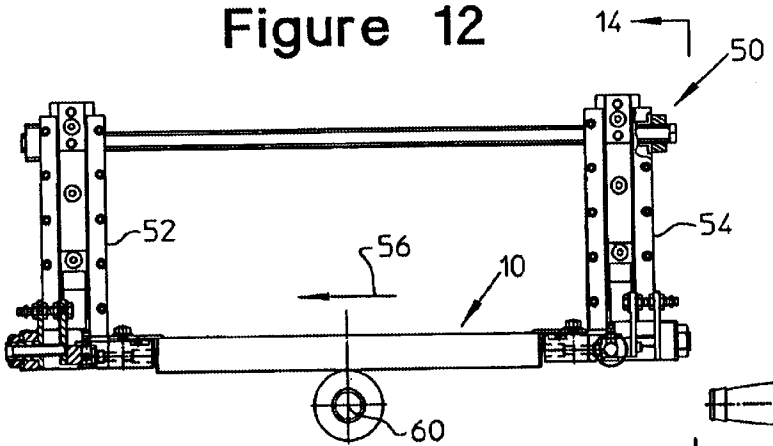
FIG. 13 is a front elevational view of the decorator machine shown in FIG. 12.
Figure 14:
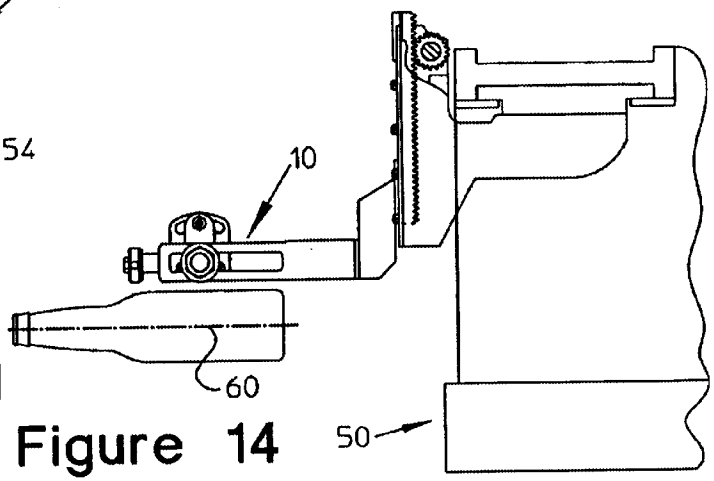
FIG. 14 is a side elevational view taken along lines 14—14 of FIG. 13.

As shown in FIGS. 12, 13 and 14, one typical form of a bottle decorating machine 50 includes spaced apart screen support arms 52 and 54 reciprocated by a motor drive and arranged to support a screen assembly 10 via the screen holder assembly 48. The screen reciprocates in the direction of arrow 56 above a beverage bottle 58 while rotated about axis 60 between bottle supports one of which is driven. In the past, should the bottle break loose from the supports, the heavy and robustly constructed screen frame transmitted the shock forces of the wreck to the screen support arms 52 and 54 causing breakage or damage of these arms and possibly damage to the associated screen drive. The screen frame 12 of the stencil screen assembly 10 according to the present invention provides a shear pin-like function because of the resilient and flexibly property of the screen frame which will allow collapsing of the geometrical shape of the frame under an impact loading occurring during such a wreck. The frame is preferably made of plain carbon steel but a carbon steel alloy featuring elevated carbon and/or manganese contents is more preferable for enhanced elastic spring properties of the screen frame with long continued integrity to accommodate intended use of the silk screen for flexing of the stencil screen frame. The limber physical characteristic of the upstanding elongated sidewalls allow resilient torsional displacement of the sidewall about axes generally identified by reference numeral 62 (FIGS. 1 and 8) extending parallel to the elongated length of the upstanding elongated sidewalls 18 and 20. The upstanding elongated sidewalls have sufficient resiliency to maintain preloaded stressing of the stencil screen along opposite longitudinal sides of the stencil screen.

After resistance heating of the screen 14 occurs sufficient to form a volume of liquefied thermo plastic ink within the reservoir 25 in the screen frame, the ink is then distributed across the face of the screen by the pressing a squeegee 49 or other well-known printing medium applicator means, against the screen which forces ink through the exposed areas of the screen as the screen is moved along a path of travel at a closely spaced site above the workpiece whereby the silk screen is pressed into contact with the surface of the workpiece.

While the present invention has been described in connection with the preferred embodiments of the various figures, it is to be understood that other similar embodiments may be used or modifications and additions may be made to the described embodiment for performing the same function of the present invention without deviating there from. Therefore, the present invention should not be limited to any single embodiment, but rather construed in breadth and scope in accordance with the recitation of the appended claims.

What is claimed is:

1. A stencil screen assembly including the combination of:

a stencil screen having a desired pattern to be imprinted defined by paint pervious openings bounded by an adhered paint-impervious layer;

a rectangular stencil screen frame including upstanding elongated sidewalls joined by spaced apart upstanding end walls to circumscribe a screen window opening establishing a stencil screen support plane; said upstanding elongated sidewalls including side plate sections generally perpendicular to said stencil, said side plate sections having sufficient resiliency to inwardly elastically bend toward each other to thereby relieve said stencil screen of a significant part of the stress while a squeegee traverses said desired pattern to be imprinted and to restore said stencil screen to said stencil screen support plane as a squeegee traverses said desired pattern to be imprinted; and screen support arms secured to said rectangular stencil screen frame to extend outwardly from said end walls.

2. The stencil screen assembly according to claim 1 wherein said upstanding elongated sidewalls have a sufficiently thin wall thickness to allow resilient torsional displacement about axes parallel to the elongated length of said upstanding elongated sidewalls.

3. The stencil screen assembly according to claim 2 wherein said upstanding elongated sidewalls are defined by L shaped cross sectional configurations having upstanding heights defining an ink reservoir volume above a projecting foot of the L shaped cross sectional configuration.

4. The stencil screen assembly according to claim 3 wherein said projecting foot defines an attachment site for adherence of said stencil screen.

5. The stencil screen assembly according to claim 1 wherein said upstanding elongated sidewalls and upstanding end walls are defined by L shaped cross sectional configurations having upstanding heights defining an ink reservoir volume above an internally projecting foot mitered at juncture sites between each of said side walls and said end walls, said projecting foot of each of said upstanding elongated sidewalls and said upstanding end walls defining a screen mounting shelf.

6. The stencil screen assembly according to claim 5 further including an electrically insulating coating on said upstanding elongated sidewalls and said upstanding end walls to electrically insulate said rectangular stencil screen frame from said stencil screen.

7. The stencil screen assembly according to claim 6 further including an electrically insulating layer of adhesive bounding an outer marginal edge portion of said stencil screen to said mounting shelf.

8. The stencil screen assembly according to claim 6 wherein said stencil screen includes electrically conductive terminal end portions extending from said upstanding elongated sidewalls along said screen support arms and pressed into electrically conductive contact with underlying bus bars.

9. The stencil screen assembly according to claim 8 wherein said screen support arms include frame support sites spaced outwardly from elongated bus bar sites substantially correspond to the width of said stencil screen traversing said spaced apart end walls, and wherein said elongated bus bar sites define compression sites for establishing electrical conductivity with electrical bus bars.

10. The stencil screen assembly according to claim 1 wherein said screen support arms include elongated plainer arms having sufficient resiliency to allow displacement of said stencil screen frame by a squeegee while traversing said desired pattern to be imprinted.

11. The stencil screen assembly according to claim 10 wherein said upstanding end walls are half divided and integral with said upstanding elongated sidewalls.

12. The stencil screen assembly according to claim 11 wherein said screen support arms further include mounting legs joined to structurally reinforce said end wall.

13. The stencil screen assembly according to claim 1 wherein said upstanding elongated sidewalls have sufficient resiliency to maintain preloaded stressing of said stencil screen along opposite longitudinal sides thereof.

14. A stencil screen assembly including the combination of:

a stencil screen having a desired pattern to be imprinted defined by an adhered paint-impervious layer, a rectangular stencil screen frame including upstanding elongated sidewalls joined by spaced apart upstanding end walls to circumscribe a screen window opening establishing a stencil screen support plane; and screen support arms secured to said rectangular stencil screen frame to extend outwardly from said end walls, said screen support arms having sufficient resiliency to downwardly elastically bend to thereby relieve said stencil screen of a significant part of the stress while a squeegee traverses said desired pattern to be imprinted and to restore said stencil screen to said stencil screen support plane as a squeegee traverses said desired pattern to be imprinted.

15. A stencil screen assembly including the combination of:

a stencil screen having a desired pattern to be imprinted defined by an adhered paint-impervious layer, said stencil screen having sufficient strength transversely to plane of the screen to allow deflection from the plane of the screen without elastic deformation;

a stencil screen frame including upstanding elongated sidewalls joined by spaced apart upstanding end walls to circumscribe a screen window opening establishing a stencil screen support plane; and screen support arms secured to said stencil screen frame to extend outwardly from said end walls, at least one of said upstanding elongated sidewalls and said screen support arms having sufficient resiliency to elastically bend to thereby relieve said stencil screen of a significant part of the stress while a squeegee traverses said desired pattern to be imprinted and to restore said stencil screen to said stencil screen support plane as a squeegee traverses said desired pattern to be imprinted.

16. A stencil screen assembly including the combination of:

a rectangular stencil screen frame including upstanding sidewalls joined by spaced apart upstanding end walls to circumscribe a stencil screen support plane, said rectangular stencil screen frame including screen support arms secured to extend outwardly from said end walls;

an electrically conductive stencil screen having a desired pattern to be imprinted defined by paint pervious openings bounded by an adhered paint-impervious layer, said electrically conductive stencil screen adhered to said elongated sidewalls with said desired pattern to be imprinted residing in said stencil screen support plane, said electrically conductive stencil screen including electrically conductive terminal end portions supported by said screen support arms remote to said end walls;

a screen holder assembly for each of said screen support arms to interconnect said rectangular stencil screen frame with spaced apart control arms of a decorating machine, said screen holder assembly for each of said screen support arms supporting an electrically conductive terminal electrically connected to an elongated electrical bus bar fastened to said screen holder assembly, said elongated electrical bus bar arranged to traverse said electrically conductive terminal end portions in a generally parallel relation with said end walls for establishing electrical contact there between when said silk screen support arms releasable mount said rectangular silk screen frame to said spaced apart control arms of a decorating machine; and fasteners to make electrically conductive contact by compressing said electrically conductive terminal end portions between said elongated electrical bus bars and said screen support arms while rigidly securing each said screen holder assembly to said screen support arms.

17. The stencil screen assembly according to claim 16 wherein said screen support arms include frame support sites spaced outwardly from elongated bus bar sites substantially correspond to the width of said stencil screen traversing said spaced apart end walls, and wherein said elongated bus bar sites define compression sites for establishing electrical conductivity with.

18. The stencil screen assembly according to claim 16 wherein said screen holder assembly for each of said screen support arms said elongated buss bar comprises a raised electrical contact rib transversely arranged above a planer face surface of an electrical insulator block.

19. The stencil screen assembly according to claim 18 wherein said elongated buss bar further includes a bar extension protruding from a lateral side thereof for receiving a fastener to attach an electrical lead wire.

* * * * *